US009296586B2

(12) United States Patent
Hata et al.

(10) Patent No.: US 9,296,586 B2
(45) Date of Patent: Mar. 29, 2016

(54) SHEET MATERIAL BINDING APPARATUS AND IMAGE FORMING SYSTEM WITH MANUAL BINDING STAND-BY POSITION

(71) Applicant: CANON KABUSHIKI KAISHA, Tokyo (JP)

(72) Inventors: Yousuke Hata, Ichikawa (JP); Kazumi Sato, Kashiwa (JP); Toshifumi Kakutani, Abiko (JP); Takeyuki Suda, Nagareyama (JP); Yoshitaka Yamazaki, Abiko (JP); Hirohisa Kato, Toride (JP); Shinya Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 14/077,716

(22) Filed: Nov. 12, 2013

(65) Prior Publication Data

US 2014/0151950 A1 Jun. 5, 2014

(30) Foreign Application Priority Data

Nov. 30, 2012 (JP) ..... 2012-261915

(51) Int. Cl.
*B65H 37/04* (2006.01)

(52) U.S. Cl.
CPC ..... *B65H 37/04* (2013.01); *B65H 2801/27* (2013.01)

(58) Field of Classification Search
CPC ..... B65H 37/04
USPC ..... 270/58.08, 58.09; 399/410
See application file for complete search history.

(56) References Cited

U.S. PATENT DOCUMENTS

| | | | | |
|---|---|---|---|---|
| 4,932,579 | A * | 6/1990 | Simonelic et al. | 227/5 |
| 5,542,655 | A * | 8/1996 | Murakami | 270/58.09 |
| 5,839,048 | A * | 11/1998 | Kato | 399/407 |
| 7,055,815 | B2 | 6/2006 | Sato et al. | |
| 7,407,156 | B2 * | 8/2008 | Iizuka et al. | 270/58.11 |
| 7,862,023 | B2 * | 1/2011 | Ichihashi et al. | 270/58.09 |
| 8,104,757 | B2 * | 1/2012 | Taki et al. | 270/58.09 |
| 2014/0239571 | A1 * | 8/2014 | Kakutani et al. | 270/58.09 |
| 2015/0037120 | A1 * | 2/2015 | Kubo | B42C 1/12 412/33 |
| 2015/0165809 | A1 * | 6/2015 | Komiyama | B42B 5/08 412/38 |
| 2015/0166295 | A1 * | 6/2015 | Kanemaru | B65H 31/02 270/58.08 |
| 2015/0183255 | A1 * | 7/2015 | Nakagomi | B65H 37/04 412/11 |

* cited by examiner

*Primary Examiner* — Patrick Mackey
(74) *Attorney, Agent, or Firm* — Fitzpatrick, Cella, Harper & Scinto

(57) ABSTRACT

Provided is a sheet material binding apparatus capable of shortening a user's waiting time required to bind sheets through a manual operation with a movable stapler. A CPU (162) of a sheet material binding apparatus (50) monitors whether or not an image forming apparatus (1) can execute image formation processing. When the image forming apparatus (1) can execute the image formation processing, the movable stapler is arranged at a standby position close to the image forming apparatus (1). When the image forming apparatus (1) cannot execute the image formation processing, on the other hand, the movable stapler is arranged at a position for performing the manual operation, to thereby bind the sheets through the manual operation immediately.

12 Claims, 6 Drawing Sheets

SHEET MATERIAL BINDING APPARATUS AND IMAGE FORMING SYSTEM WITH MANUAL BINDING STAND-BY POSITION

BACKGROUND OF THE INVENTION

1. Field of the Invention

The present invention relates to an image forming system including an image forming apparatus such as a copying machine and a multifunction peripheral, and a post-processing apparatus for performing post-processing after image formation.

2. Description of the Related Art

Image forming systems may include a post-processing apparatus for performing various kinds of post-processing on a sheet material having an image formed thereon by an image forming apparatus. As this type of post-processing apparatus, for example, there is known a sheet material binding apparatus including a stapler for binding a sheet material bundle formed of a plurality of sheet materials through use of a binding member such as a metal staple.

In a general sheet material binding apparatus, the sheet material bundle delivered from the image forming apparatus is automatically bound by the stapler ("automatic stapling"). On the other hand, there is a demand from users to bind the sheet material bundle through a manual operation ("manual stapling") instead of the automatic stapling.

To meet the users' demand as described above, U.S. Pat. No. 7,407,156 discloses such a technology that the user manually inserts the sheet material bundle through a delivery port of the post-processing apparatus, to thereby bind the sheet material bundle with the stapler.

In the technology disclosed in U.S. Pat. No. 7,407,156, when binding the sheet material bundle through the manual operation, the user needs to insert the sheet material bundle through the delivery port provided in a side surface of the post-processing apparatus. Therefore, there is a drawback in operability. From the viewpoint of enhancing the operability, it is conceived that the insertion port for the sheet material bundle is arranged in a front surface of the post-processing apparatus, which is highly accessible to the user.

In the configuration as described above, however, the position for automatic binding is different from the position for manual binding, and hence the stapler needs to be moved by a shifting mechanism. The shifting mechanism is a mechanism for shifting the position of the stapler while holding the stapler. Through the movement of the stapler, the sheet material bundle can be bound at various positions, but the user needs to wait during a period in which the stapler is moving. Therefore, there is a problem in that the work efficiency cannot be enhanced.

This problem arises in common to all the post-processing apparatus in modes that involve the movement of the stapler at the time of binding the sheet material bundle.

Further, when dedicated staplers are provided for the automatic binding and the manual binding, respectively, there is a problem in that the cost increases.

SUMMARY OF THE INVENTION

The present invention has been made to solve the above-mentioned problems, and it is therefore a main object thereof to provide a sheet material binding apparatus and an image forming system, which are capable of shortening a user's waiting time required to move an existing stapler without providing a dedicated stapler for manual stapling.

In order to achieve the above-mentioned object, according to one embodiment of the present invention, there is provided a sheet material binding apparatus including a binding mechanism and a shifting mechanism. The binding mechanism binds a sheet material bundle formed of a plurality of sheet materials. The shifting mechanism shifts a position of the binding mechanism between: a first binding position for binding the sheet material bundle fed from an external apparatus connected to the sheet material binding apparatus so as to be capable of feeding the plurality of sheet materials; and a second binding position for binding the sheet material bundle fed from a feeder other than the external apparatus. The sheet material binding apparatus monitors an operation state of the external apparatus. The sheet material binding apparatus further includes a control section for controlling, when the external apparatus is in a state of being capable of feeding the plurality of sheet materials, the shifting mechanism so as to arrange the binding mechanism at the first binding position. When the external apparatus is in a state of being incapable of feeding the plurality of sheet materials, the control section controls the shifting mechanism so as to arrange the binding mechanism at the second binding position.

Further, according to one embodiment of the present invention, there is provided an image forming system including an image forming section for forming an image on a sheet material, and a binding mechanism for binding a sheet material bundle formed of a plurality of the sheet materials fed from the image forming section. The image forming system further includes a shifting mechanism for shifting a position of the binding mechanism between: a first binding position for binding the sheet material bundle fed from the image forming section; and a second binding position for binding the sheet material bundle fed from a feeder other than the image forming section. The image forming system further includes a control section for monitoring an operation state of the image forming section, and controlling, when the image forming section is in a state of being capable of feeding the plurality of sheet materials, the shifting mechanism so as to arrange the binding mechanism at the first binding position. When the image forming section is in a state of being incapable of feeding the plurality of sheet materials, the control section controls the shifting mechanism so as to shift the binding mechanism to the second binding position.

According to one embodiment of the present invention, when the external apparatus such as an image forming apparatus is in the state of being capable of feeding the sheet materials, the binding mechanism is arranged at the first binding position for binding the sheet material bundle fed from the external apparatus. When the external apparatus is in the state of being incapable of feeding the sheet materials, on the other hand, the binding mechanism is arranged at the second binding position for binding the sheet material bundle fed from a feeder other than the external apparatus. In this manner, the binding mechanism is located at a position close to the feed source of the sheet materials, and hence the waiting time required to bind the sheet material bundle can be shortened.

Further features of the present invention will become apparent from the following description of exemplary embodiments (with reference to the attached drawings).

BRIEF DESCRIPTION OF THE DRAWINGS

FIG. 6 is an explanatory flow chart illustrating procedures of an operation of changing the stapler standby position when power is ON.

DESCRIPTION OF THE EMBODIMENTS

Now, an embodiment of the present invention is described.

Embodiment

Figure 1:
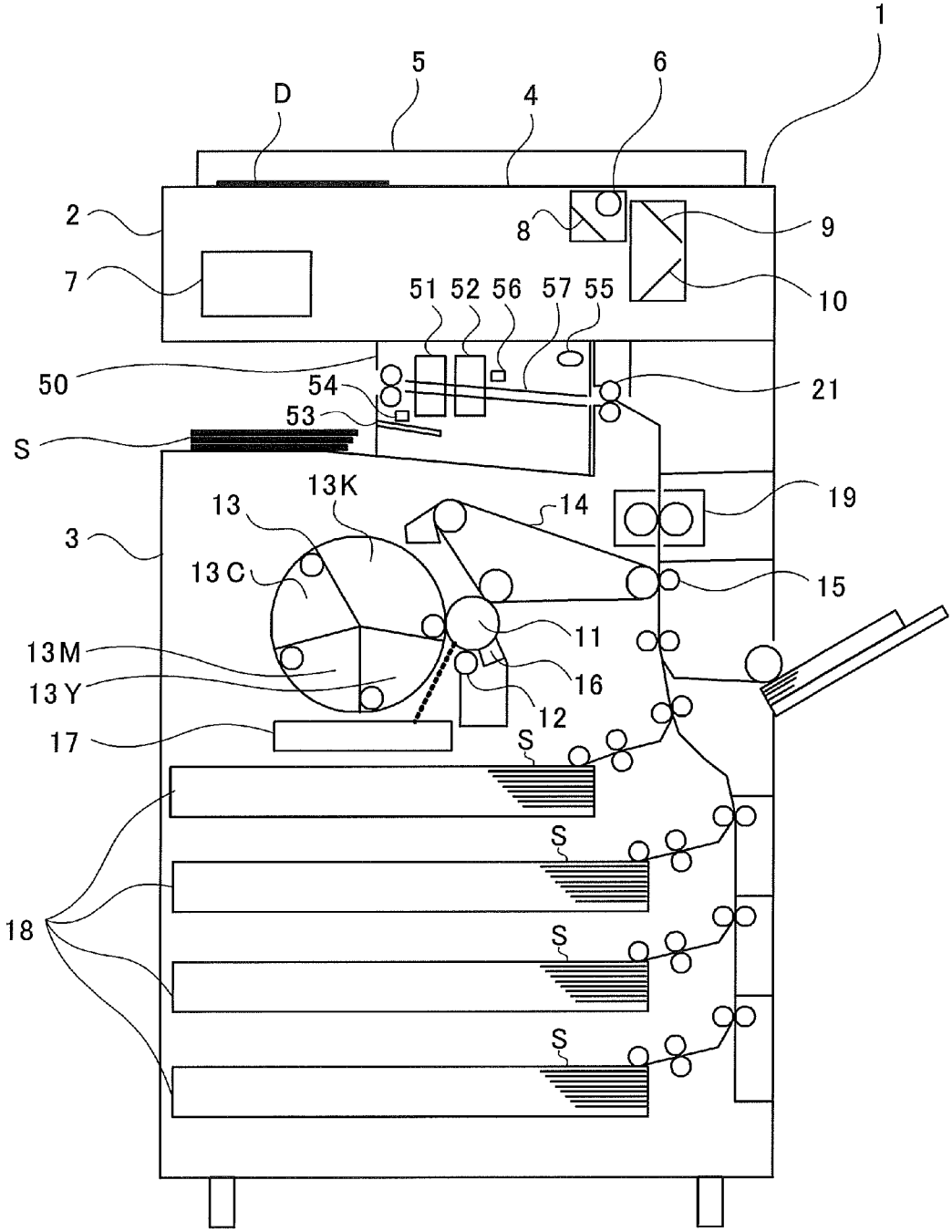
FIG. 1 is an overall configuration diagram illustrating an image forming system.

FIG. 1 is an overall configuration diagram illustrating an image forming system according to this embodiment. The image forming system includes an image forming apparatus 1 and a sheet material binding apparatus 50. The sheet material binding apparatus 50 is taken as an example of a post-processing apparatus for performing post-processing on a sheet material received from the image forming apparatus 1 after image formation. In relation to the sheet material binding apparatus 50, the image forming apparatus 1 is taken as an example of an external apparatus connected to the sheet material binding apparatus 50 so as to be capable of feeding a sheet material.

<Mechanism of Image Forming Apparatus>

The image forming apparatus 1 includes an image reading section 2 for reading an image of an original, and an image forming section 3 for forming the image on a sheet material. In this embodiment, a sheet S is used as the sheet material. Further, a toner that is an example of a developer is used as a color material for image formation.

An original table 4 formed of a transparent glass plate is provided at an upper portion of the image reading section 2. A user places an original D at a predetermined position on the original table 4 with its image surface oriented downward, and then presses and fixes the original D with an original pressing plate 5. An optical system is provided on a lower side of the original table 4. The optical system includes a lamp 6 for illuminating the original D, and reflection mirrors 8, 9, and 10 for guiding an optical image of the illuminated original D to an image sensor of an image processing unit 7. The lamp 6 and the reflection mirrors 8, 9, and 10 move at a predetermined speed to scan the original D.

The image forming section 3 includes a photosensitive drum 11, a primary charging roller 12, a rotary developing unit 13, an intermediate transfer belt 14, a transfer roller 15, a cleaner 16, a laser unit 17, sheet cassettes 18, a fixing device 19, and a delivery roller pair 21. The primary charging roller uniformly charges a surface of the photosensitive drum 11 before laser light irradiation. Based on image data, the laser unit 17 irradiates the charged surface of the photosensitive drum 11 with the optical image to form electrostatic latent images. The rotary developing unit 13 adheres magenta, cyan, yellow, ad black toners to the electrostatic latent images formed on the surface of the photosensitive drum 11 to form toner images.

A rotary developing system is employed in the rotary developing unit 13, and the rotary developing unit 13 includes a developing device 13K, a developing device 13Y, a developing device 13M, and a developing device 13C, and is rotatable by a motor (not shown). The developing device 13K, the developing device 13Y, the developing device 13M, and the developing device 13C are used for developing a black toner image, a yellow toner image, a magenta toner image, and a cyan toner image, respectively. When forming a monochrome toner image on the photosensitive drum 11, the developing device 13K is moved through rotation to a developing position that is proximate to the photosensitive drum 11, to thereby develop the toner image. Similarly, when forming a full-color toner image, each of the developing devices 13Y to 13K is arranged at the developing position through the rotation of the rotary developing unit 13, to thereby develop the toner image of the corresponding color.

The toner images developed on the surface of the photosensitive drum 11 are transferred onto the intermediate transfer belt 14. The toner images on the intermediate transfer belt 14 are transferred by the transfer roller 15 onto the sheet S that is fed from one of the sheet cassettes 18. The cleaner 16 removes the toners remaining on the photosensitive drum 11 after the toner images are transferred. The fixing device 19 heats and pressurizes the conveyed sheet S to fix the toner images on the sheet S. The sheet S having the toner images fixed thereto by the fixing device 19 is delivered from the image forming apparatus by the delivery roller pair 21. The sheet S is delivered from the image forming apparatus 1 to the sheet material binding apparatus 50 that is installed on a downstream side of the image forming apparatus 1.

<Mechanism of Sheet Material Binding Apparatus>

Next, the sheet material binding apparatus 50 is described. The sheet material binding apparatus 50 is provided at a position at which the sheet S is delivered from the image forming apparatus 1. The sheet material binding apparatus 50 includes a binding mechanism for receiving the sheet S delivered from the image forming apparatus 1, and binding a sheet bundle formed of a plurality of the sheets S (example of a sheet material bundle formed of a plurality of sheet materials), a shifting mechanism for moving the binding mechanism, and a control mechanism for controlling the shifting mechanism. The sheet material binding apparatus 50 and the image forming apparatus 1 communicate to and from each other via a signal line (not shown), to thereby mutually monitor the states thereof and operate in cooperation.

The sheet material binding apparatus 50 includes a movable stapler 51, an eco-stapler 52, a manual stapling sheet insertion port 53, a manual stapling sheet detection sensor 54, a manual stapling execution button 55, a sheet detection sensor 56, and a sheet alignment section 57. The movable stapler 51 is a stapler that shifts (moves) its position by the above-mentioned shifting mechanism.

When the sheet detection sensor 56 for detecting the presence and absence of the sheets S detects the sheets S delivered to the sheet alignment section 57, the movable stapler 51 and the eco-stapler 52 bind the sheets S in accordance with a binding mode set by the user.

The movable stapler 51 binds the sheets S through use of a staple. The eco-stapler 52 includes an upper tooth portion and a lower tooth portion that are engageable with each other. The eco-stapler 52 sandwiches and pressurizes the sheet bundle between the upper tooth portion and the lower tooth portion, to thereby bind the sheet bundle without use of a staple.

The manual stapling sheet insertion port 53 is provided so that the user manually inserts the sheet bundle therethrough. The manual stapling sheet detection sensor 54 detects that the sheet bundle is inserted through the manual stapling sheet insertion port 53. When the manual stapling sheet detection sensor 54 detects the sheet bundle, the manual stapling execution button 55 is brought into a depressible (pushable) state.

When the user depresses the manual stapling execution button 55, the sheet bundle is bound by the movable stapler 51.

Now, the movable stapler 51 is described in detail.

Figure 2:
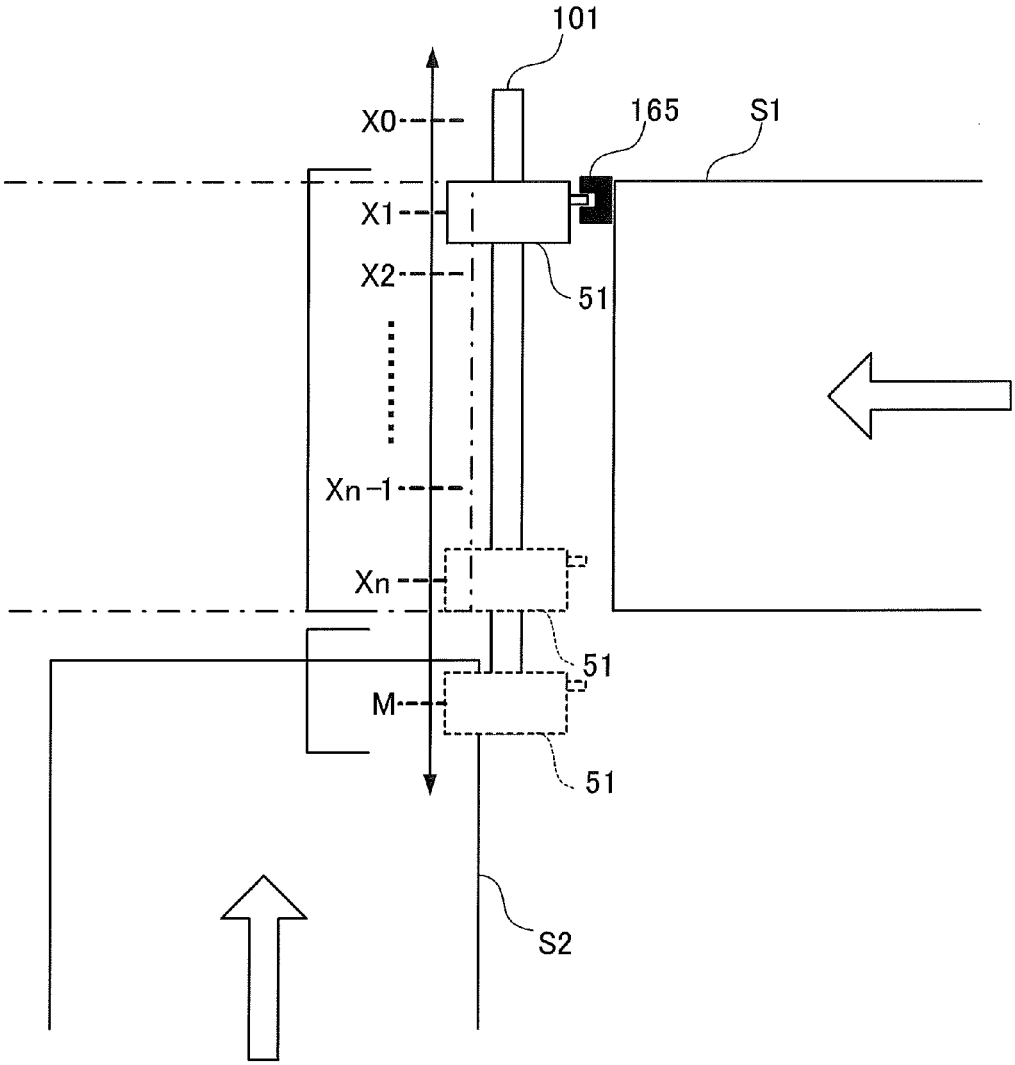
FIG. 2 is an explanatory view illustrating a movable stapler.

FIG. 2 is a sectional view illustrating the sheet material binding apparatus 50 as seen from the top. The lower side of FIG. 2 corresponds to a front surface side of the sheet material binding apparatus 50 illustrated in FIG. 1. The movable stapler 51 takes two roles. One is a role of an automatic stapling function for automatically binding sheets S1 delivered from the image forming apparatus 1. The other is a role of a manual stapling function for manually binding sheets S2 inserted through the manual stapling sheet insertion port 53.

When the movable stapler 51 is used for the automatic stapling function, the movable stapler 51 binds the sheets S1 in accordance with a binding position set by the user. Therefore, the movable stapler 51 moves along a movement path 101 under the control of the shifting mechanism, and binds the sheets S1 at an arbitrary position (hereinafter referred to as "automatic stapling position" or "first binding position") selected from among positions X1 to Xn. The position of the sheets S1 to be subjected to the automatic stapling is a position indicated by the chain line in FIG. 2. Note that, the number of the sheets S1 that can be bound at the automatic stapling position differs depending on product specifications of the sheet material binding apparatus 50.

When the movable stapler 51 is used for the manual stapling function, on the other hand, the movable stapler 51 binds a bundle of the sheets S2 inserted through the manual stapling sheet insertion port 53. The manual stapling sheet insertion port 53 is provided on the front surface side of the sheet material binding apparatus 50. Therefore, when binding the sheets S2 through the manual stapling, the movable stapler 51 is moved to a movement position M (hereinafter referred to as "manual stapling position" or "second binding position"). Note that, when the movable stapler 51 does not bind the sheets, the movable stapler 51 is retreated to a position that does not hinder the conveyance of the sheets, for example, a position X0 or the manual stapling position M.

The position of the movable stapler 51 is detected by a movable stapler position detection sensor 165 provided on the movement path 101. The position X1 of the movable stapler 51 is defined as a standby position. The movement of the movable stapler 51 to the other positions is controlled based on movement distances from the standby position. For example, when a stepper motor is used as a drive source for the movable stapler 51, the position of the movable stapler 51 is controlled by changing the number of drive pulses to be output.

Note that, the standby position may be set to a position other than the position X1. For example, the standby position may be set to the manual stapling position M.

As described above, the position of the movable stapler 51 differs between the case where the movable stapler 51 is used for the automatic stapling function and the case where the movable stapler 51 is used for the manual stapling function. Therefore, it is necessary to move the movable stapler 51 to an appropriate position in accordance with the respective cases. At this time, it is also necessary to consider a time period required for the movement of the movable stapler 51. This is because a waiting time required to bind the sheets through the automatic stapling or the manual stapling changes depending on the standby position of the movable stapler 51.

<Function of Entire Image Forming System>

Figure 3:
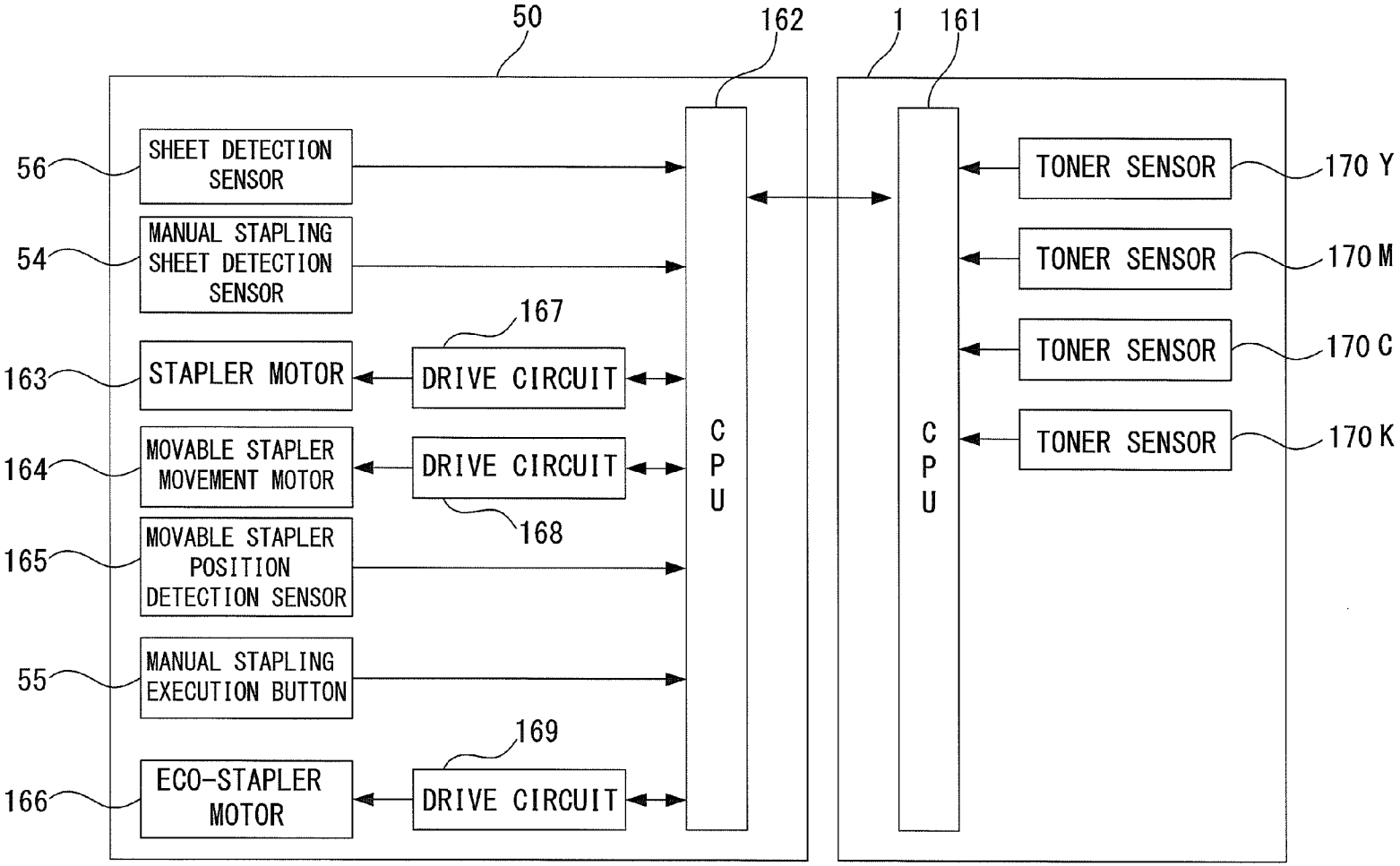
FIG. 3 is a configuration diagram illustrating a control device of the image forming system.

FIG. 3 is a configuration diagram illustrating a control device of the image forming system.

The sheet material binding apparatus 50 is mainly controlled by a CPU 162. The CPU 162 communicates to and from a control device for controlling the image forming apparatus 1, for example, a CPU 161, to thereby mutually detect (or determine) the operation states thereof.

The sheet detection sensor 56 detects the presence and absence of the sheets in the sheet alignment section 57 (see FIG. 1), and notifies the CPU 162 of the detection result. The manual stapling sheet detection sensor 54 detects the presence and absence of the sheets in the manual stapling sheet insertion port (see FIG. 1), and notifies the CPU 162 of the detection result. A stapler motor 163 is provided inside the movable stapler 51 (see FIG. 1), and drives the movable stapler 51 to bind the sheets. A drive circuit 167 controls the stapler motor 163. A movable stapler movement motor 164 is formed of a stepper motor, and moves the movable stapler 51 to an arbitrary position by changing the number of drive pulses to be output in accordance with the distance detected by the movable stapler position detection sensor 165. A drive circuit 168 is configured to drive the movable stapler movement motor 164. When the manual stapling execution button 55 is depressed, a signal is transmitted to the CPU 162 to notify that the manual stapling execution button 55 is depressed. An eco-stapler motor 166 is provided inside the eco-stapler 52 (see FIG. 1), and is driven by a drive circuit 169 so that the eco-stapler 52 binds the sheets.

Considering that the automatic stapling is normally used with high frequency, the standby position of the movable stapler 51 is set to an automatic stapling position that is located on a rear side of the sheet material binding apparatus 50 (position X1 illustrated in FIG. 2). Therefore, even when the sheets are inserted through the manual stapling sheet insertion port 53 provided on the front surface side of the sheet material binding apparatus 50, the manual stapling cannot be executed immediately. To bind the sheets through the manual stapling, the movable stapler 51 needs to wait for a time period equal to or longer than a time period required for the movement from the position X1 that is the standby position to the manual stapling position (manual stapling position M illustrated in FIG. 2). The time period required for the movement depends on a mounting mechanism of the movable stapler 51. In this embodiment, the time period is about 5 seconds.

When the image forming apparatus 1 is in a state in which the print job cannot be executed, however, the movable stapler 51 is not used for the automatic stapling function. Therefore, the movable stapler 51 does not originally need to stand by at the position X1 constantly. The state in which the print job cannot be executed is, for example, a state in which the amounts of remaining toners of the developing device 13K, the developing device 13Y, the developing device 13M, and the developing device 13C become less than a predefined value. That is, this state corresponds to a case where any one of toner sensors 170Y, 170M, 170C, and 170K (hereinafter referred to as "toner sensors 170Y to 170K") detects decrease in amount of the remaining toner. In this case, the image forming apparatus 1 is brought into a state in which the image formation processing cannot be executed unless the developing device is replenished with the toner through work of replacing a toner bottle or the like. As a result, no sheets are fed from the image forming apparatus 1.

Further, the state in which the image forming apparatus 1 cannot execute the print job includes a state in which a calibration operation for the image forming apparatus is being executed. The calibration operation includes a density adjustment operation for adjusting image formation conditions based on results of measuring the density of an image that is formed for density measurement, and a color misalignment adjustment operation for correcting relative positional misalignment of the toner images based on timings of detection of images that are formed for positional adjustment of the respective colors. Still further, the state in which the image forming apparatus 1 cannot execute the print job includes a state in which the sheet is not present or the sheet is jammed in the image forming apparatus 1. Still further, the state in which the image forming apparatus 1 cannot execute the print job includes a state in which the temperature of the fixing device 19 falls out of a temperature range that allows the fixation.

Under the states as described above, it is preferred that the movable stapler 51 of the sheet material binding apparatus 50 be moved in advance to the manual stapling position M in preparation for binding the sheets through the manual stapling, in which the sheet materials to be bound do not pass through the image forming apparatus 1.

<Operation to be Performed when Amount of Remaining Toner Decreases>

Figure 4:
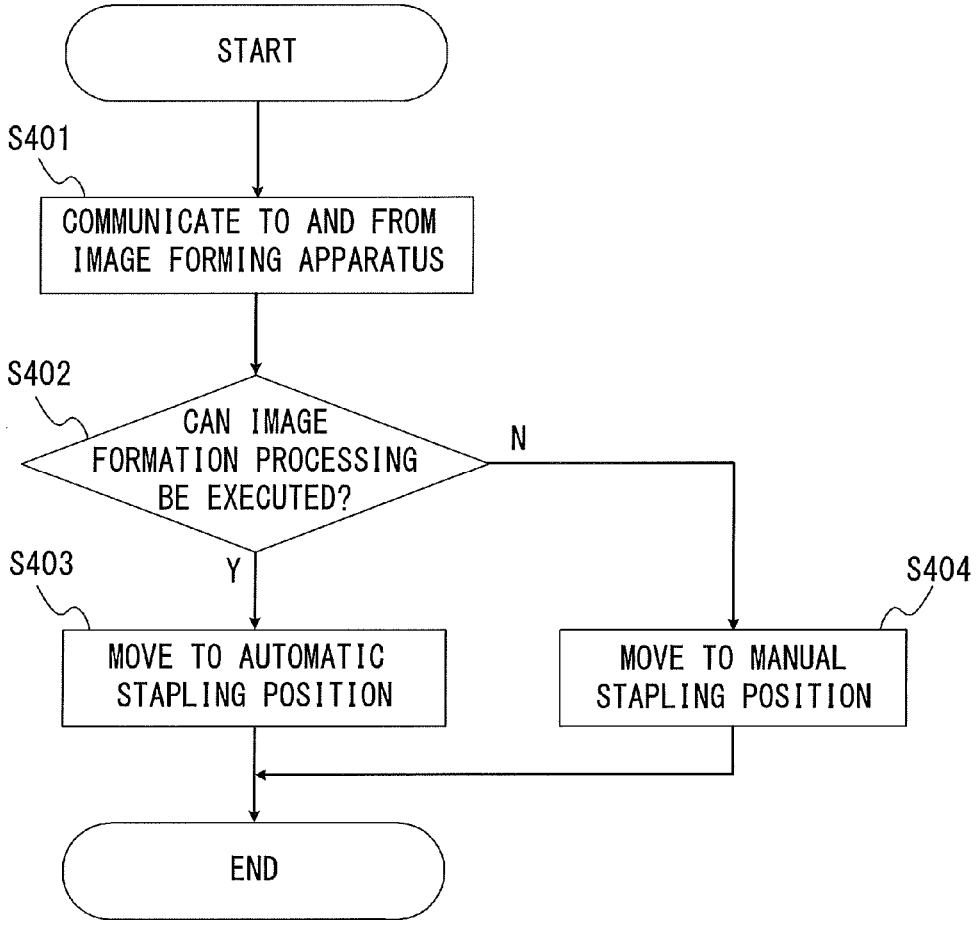
FIG. 4 is an explanatory flow chart illustrating procedures of an operation of changing a stapler standby position when a toner is not present.

Control of an operation of changing the standby position of the movable stapler 51 when the amount of the remaining toner decreases is performed through, for example, the procedures of FIG. 4.

The control of the operation of changing the standby position of the movable stapler 51 is performed in cooperation between the control device of the sheet material binding apparatus 50 (CPU 162) and the control device of the image forming apparatus 1 (CPU 161). The CPU 162 of the sheet material binding apparatus 50 periodically communicates to and from the image forming apparatus 1 (CPU 161) so as to exchange operation information or the like (S401).

Based on the operation information received from the CPU 161, the CPU 162 determines whether the image forming apparatus 1 is in a state in which the image formation processing can be executed ("first state") or in a state in which the image formation processing cannot be executed ("second state") (S402). When the image forming apparatus 1 is normally operated, the CPU 161 transmits, to the CPU 162, information indicating that the image formation processing can be executed. For example, at least under the condition that consumable materials necessary for the image formation are not used up, the CPU 161 transmits, to the CPU 162, the information indicating that the image formation processing can be executed.

On the other hand, when the amounts of the remaining toners detected by the toner sensors 170Y to 170K become less than the predefined value, for example, the CPU 161 transmits, to the CPU 162, information indicating that the image forming apparatus 1 cannot execute the image formation processing.

In this manner, the CPU 162 can monitor the state of the image forming apparatus 1.

When the image forming apparatus 1 is in the state in which the image formation processing can be executed (S402: Y), the CPU 162 causes the movable stapler 51 to move to the position X1 that is selected from among the automatic stapling positions (S403). When the movable stapler 51 already stands by at the position X1, the movable stapler 51 is left at the same position.

When the image forming apparatus 1 is in the state in which the image formation processing cannot be executed (S402: N), on the other hand, the CPU 162 causes the drive circuit 168 to drive the movable stapler movement motor 164, to thereby move the movable stapler 51 to the manual stapling position M (S404). Further, instead of the case where the toner is not present, in a case where the sheet material to be used for the image formation is not present, the movable stapler 51 is moved to the manual stapling position M.

The CPU 162 periodically executes the above-mentioned procedures. After it is detected that the toner is not present in the image forming apparatus 1, the image formation processing cannot be executed again until the user or service engineer replenishes the developing device with the toner. However, it is not determined when this state is resolved.

Therefore, in this embodiment, the CPU 162 periodically monitors the state of the image forming apparatus 1. At a timing when the image forming apparatus 1 can execute the image formation processing, the movable stapler 51 is moved to the position X1. Thus, the waiting time required to bind the sheets through the automatic stapling can be shortened. Further, the movable stapler 51 can be retained at the manual stapling position M as long as possible, and hence the waiting time required to bind the sheets through the manual stapling can be shortened as well.

<Operation to be Performed when Power Saving Mode is Set>

Also when the image forming apparatus 1 shifts from a normal mode to a power saving mode for saving standby power, the sheet material binding apparatus 50 causes the movable stapler 51 to change the standby position thereof. The "power saving mode" refers to an operation mode to be set for reducing the standby power of the image forming apparatus 1. After the image forming operation, the image forming apparatus 1 shifts from the normal mode to the power saving mode when a preset time period has elapsed under a state in which no operation is input by the user. Alternatively, the user may select the power saving mode by operating the image forming apparatus 1 through an operation section or the like. In the power saving mode, the power to the load such as the fixing device 19, which is large in power consumption, is mainly turned OFF while maintaining the power supply to the sensors, the buttons, and the like. Also in the case of the power saving mode, no sheets are fed from the image forming apparatus 1 to the sheet material binding apparatus 50. Therefore, in the sheet material binding apparatus 50, the movable stapler 51 is moved to the manual stapling position M.

Figure 5:
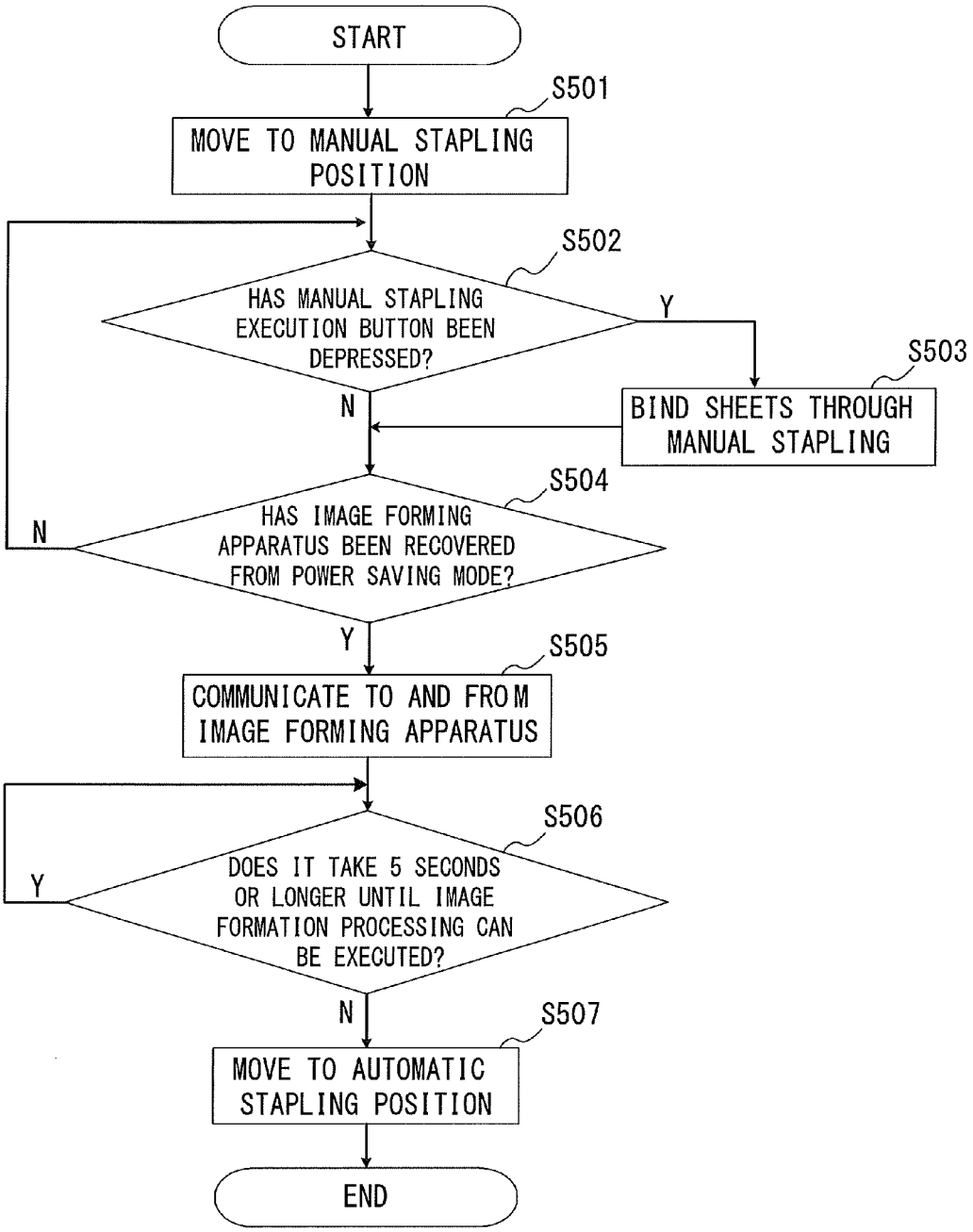
FIG. 5 is an explanatory flow chart illustrating procedures of an operation of changing the stapler standby position when a power saving mode is set.

FIG. 5 is an explanatory flow chart illustrating procedures of an operation to be executed by the CPU 162 when the power saving mode is set.

The shift of the image forming apparatus 1 from the normal mode to the power saving mode can be detected based on the operation information acquired by the CPU 162 from the CPU 161. At this time, the CPU 162 causes the movable stapler 51 to move to the manual stapling position M (S501), and monitors whether or not the manual stapling execution button is depressed by the user (S502). When the manual stapling execution button is depressed (S502: Y), the CPU 162 binds the sheets through the manual stapling (S503). When the manual stapling execution button is not depressed (S502: N), and when it is determined based on the operation information from the CPU 161 that the image forming apparatus 1 is not recovered from the power saving mode, the operation returns to the processing of S502 (S504: N).

When it is determined based on the operation information from the CPU 161 that the image forming apparatus 1 is recovered from the power saving mode (S504: Y), the CPU 162 communicates to and from the image forming apparatus 1 (CPU 161), and acquires a time period required until the image formation processing can be executed (S505).

There are two kinds of time period required until the image formation processing can be executed. One is a time period after the image forming apparatus is recovered from the power saving mode until the image formation processing can be executed in the normal mode ("first time period"). The other is a time period required for the movement of the movable stapler 51, that is, a time period required for the movement from the manual stapling position M to the automatic stapling position (X1) ("second time period"). When the time period required for the movement of the movable stapler 51 is already detected by the CPU 161, the time period is acquired from the CPU 161. When the time period is set on the sheet material binding apparatus 50 side, the time period is acquired from the part in which the time period is set. In this embodiment, the time period required for the movement of the movable stapler 51 from the manual stapling position M to the automatic stapling position (X1) is 5 seconds.

In S505, it is assumed that the first time period is acquired, but the second time period may be acquired together with the first time period. The CPU 162 determines whether or not the time period required until the image formation processing can be executed is equal to or longer than 5 seconds (equal to or longer than the second time period) (S506). When the time period is equal to or longer than 5 seconds (S506: Y), the CPU 162 causes the movable stapler 51 to still stand by at the manual stapling position M. When the time period is shorter than 5 seconds (shorter than the second time period) (S506: N), on the other hand, the CPU 162 causes the movable stapler 51 to move to the automatic stapling position (X1) (S507).

In this manner, also when the image forming apparatus 1 is set in the power saving mode, the movable stapler 51 can be caused to stand by at the manual stapling position. Thus, it is possible to save the time period required for the movement of the movable stapler 51 from the automatic stapling position (X1) to the manual stapling position M when binding the sheets through the manual stapling in the power saving mode.

When the image forming apparatus 1 is recovered from the power saving mode, on the other hand, it is necessary to move the movable stapler 51 to the automatic stapling position (X1). When the image forming apparatus 1 is recovered from the power saving mode, however, an initial adjustment operation is normally executed for the image forming apparatus 1. Therefore, the image forming apparatus 1 is not immediately recovered to the normal mode. For example, the fixing device 19 normally requires a given length of time to raise the temperature to about 200° C. This time period ranges from several tens of seconds to several minutes.

In this embodiment, the movable stapler 51 is moved from the manual stapling position M to the automatic stapling position (X1) in synchronization with the timing when the image forming apparatus 1 can execute the image formation processing. Thus, the movable stapler 51 can be caused to stand by at the manual stapling position M as long as possible, and hence the waiting time required to bind the sheets through the manual stapling can be shortened.

In this embodiment, the temperature of the fixing device 19 is controlled, but as a matter of course, the present invention is not limited thereto. For example, also when a given length of time is required to allow the image formation as in a case of an image adjustment operation, the standby position of the movable stapler 51 can be changed through similar control procedures.

<Operation to be Performed when Power is ON>

Figure 6:
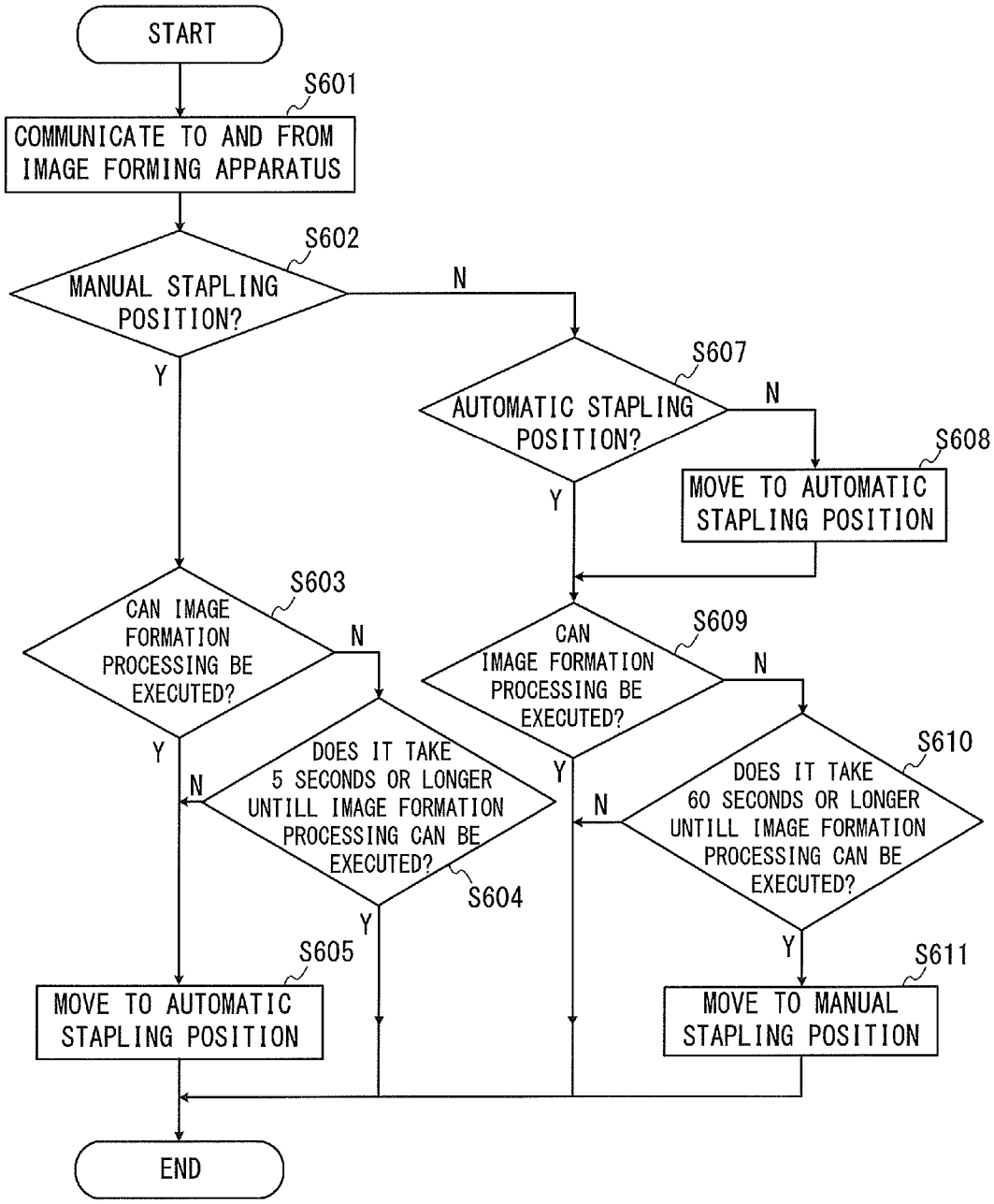

The standby position of the movable stapler 51 is basically set to the automatic stapling position (for example, the position X1 in FIG. 2), but during the power saving mode of the image forming apparatus 1, the movable stapler 51 is located at the manual stapling position M. Therefore, depending on the timing to turn OFF the power of the image forming apparatus 1, the position of the movable stapler 51 differs when the power of the image forming apparatus 1 is turned ON next time. An operation of changing the standby position of the movable stapler 51 at this time is described with reference to FIG. 6.

When the power of the image forming apparatus 1 is turned ON, the CPU 162 becomes communicable to and from the CPU 161 of the image forming apparatus 1. Therefore, based on the operation information from the CPU 161, the CPU 162 detects the state of the image forming apparatus 1 (S601). For example, the CPU 162 determines whether the image forming apparatus 1 is in the state in which the image formation processing can be executed ("first state") or in the state in which the image formation processing cannot be executed ("second state"). When the image forming apparatus 1 is in the state in which the image formation processing cannot be executed, that is, in the "second state," the CPU 162 detects the time period required until the image formation processing can be executed through the movement of the movable stapler 51 ("second time period"). The second time period ranges from about 5 seconds to several minutes depending on the state in which the image formation processing cannot be executed. Further, the CPU 162 determines whether or not the position of the movable stapler 51 is the manual stapling position M (S602). When the position of the movable stapler 51 is the manual stapling position M (S602: Y), the CPU 162 determines whether or not the image forming apparatus 1 is in the first state, that is, in the state in which the image formation processing can be executed (S603). When the image formation processing can be executed (S603: Y), the CPU 162 causes the movable stapler 51 to move to the automatic stapling position (X1) (S605). When the image forming apparatus 1 is in the second state, that is, in the state in which the image formation processing cannot be executed (S603: N), on the other hand, the CPU 162 determines whether or not the time period required until the image formation processing can be executed is shorter than the time period required for the movement of the movable stapler 51, that is, 5 seconds (S604). When the time period is equal to or longer than 5 seconds (S604: Y), 5 seconds corresponding to a time period required until the movable stapler 51 returns to the automatic stapling position is secured, and hence the CPU 162 causes the movable stapler 51 to still stand by at the manual stapling position M.

When the time period required until the image formation processing can be executed is shorter than 5 seconds (S604: N), the CPU 162 causes the movable stapler 51 to move to the automatic stapling position (X1) (S605).

When the position of the movable stapler 51 at the time at which the power is ON is not the manual stapling position M (S602: N), on the other hand, the CPU 162 determines whether or not the position is the automatic stapling position (X1) (S607). When the position is not the automatic stapling position (X1), the CPU 162 causes the movable stapler 51 to move to the automatic stapling position (X1) (S607: N, S608). When the position of the movable stapler 51 is the automatic stapling position (X1) (S607: Y), based on the operation information from the CPU 161, the CPU 162 determines whether or not the image forming apparatus 1 can execute the image formation processing (S609). The same determination is also performed when the movable stapler 51 is moved to the automatic stapling position (X1). When the image forming apparatus 1 is in the state in which the image formation processing can be executed (S609: Y), the CPU 162 causes the movable stapler 51 to still stand by at the automatic stapling position (X1). When the image formation processing cannot be executed (S609: N), the CPU 162 acquires, from the CPU 161, the time period required until the image formation processing can be executed. As described above, a considerable length of time is required for the recovery of the fixing device 19. Therefore, when the time period required until the image formation processing can be executed is equal to or longer than 60 seconds (S610: Y), the CPU 162 causes the movable stapler 51 to move to the manual stapling position M (S611). This is because the standby time at the manual stapling position M can be secured even in consideration of about 10 seconds corresponding to a time period required for reciprocating movement of the movable stapler 51.

When the time period required until the image formation processing can be executed is shorter than 60 seconds (S610: N), the CPU 162 causes the movable stapler 51 to still stand by at the automatic stapling position (X1).

In this manner, when the movable stapler 51 is located at the manual stapling position M at the time at which the power of the image forming apparatus 1 is turned ON, the CPU 162 does not cause the movable stapler 51 to immediately move to the automatic stapling position (X1). While monitoring the state of the image forming apparatus 1, the CPU 162 controls the movable stapler 51 to move to the automatic stapling position in synchronization with the timing when the image formation processing can be executed. Thus, it is possible to shorten the user's waiting time required to bind the sheets through the manual stapling.

The above description is given on the premise that the sheet material binding apparatus 50 is installed in the space between the image reading section 2 and the image forming section 3 of the image forming apparatus 1. However, the present invention is not limited to this installation manner. The sheet material binding apparatus 50 may also be provided as an independent apparatus to be used in conjunction with the image forming apparatus 1. Further, the sheet material binding apparatus 50 is described as an example of the post-processing apparatus, but the movable stapler 51 may be mounted on the image forming apparatus 1 itself. Still further, the stapler using a staple is described as an example of the movable stapler 51, but the movable stapler 51 may also be applied to other sheet binding mechanisms. Still further, the CPU 161 of the image forming apparatus 1 may control the sheet material binding apparatus 50.

Note that, the time periods of 5 seconds and seconds are described only as an example in this embodiment, and those time periods may be changed arbitrarily.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-261915, filed Nov. 30, 2012, which is hereby incorporated by reference herein in its entirety.

What is claimed is:

1. A sheet material binding apparatus adapted to be connected to an image forming apparatus which performs a print job, comprising:

a binding mechanism configured to bind a sheet material bundle formed of a plurality of sheet materials;

a motor configured to move a position of the binding mechanism between:

a first position, at which the binding mechanism stands by to bind a sheet bundle formed of a plurality of sheets fed from the image forming apparatus in a print job, and a second position, at which the binding mechanism stands by to bind the sheet material bundle manually supplied; and a control section configured to control the motor so as to, in a case where the image forming apparatus is in a state of being incapable of performing the print job, arrange the binding mechanism at the second position.

2. A sheet material binding apparatus according to claim 1, wherein the control section is configured to:

in the case where the image forming apparatus is in the state of being incapable of performing the print job, acquire a first time period required until the image forming apparatus becomes capable of performing the print job, and a second time period required for movement of the binding mechanism between the first position and the second position, if the first time period is shorter than the second time period, control the motor so as to arrange the binding mechanism at the first position, and if the first time period is longer than the second time period, control the motor so as to arrange the binding mechanism at the second position.

3. A sheet material binding apparatus according to claim 2, wherein the control section is configured to, in a case where the first time period is equal to the second time period, control the motor so as to arrange the binding mechanism at the second position.

4. A sheet material binding apparatus according to claim 1, wherein, in a case where an amount of a remaining developer used for the print job is less than a predefined value, the control section controls the motor so as to move the binding mechanism to the second position.

5. A sheet material binding apparatus according to claim 4, wherein, in a case where the image forming apparatus shifts to a power saving mode for saving power of the image forming apparatus at a time at which the image forming apparatus does not perform the print job, the control section controls the motor so as to arrange the binding mechanism at the second position.

6. A sheet material binding apparatus according to claim 1, wherein, in a case where the image forming apparatus is in a state of being capable of performing the print job, the control section controls the motor so as to arrange the binding mechanism at the first position.

7. A sheet material binding apparatus according to claim 1, wherein, in a case where the image forming apparatus is in the state of being incapable of performing the print job and an estimated time period required until the image forming apparatus is brought into a state of being capable of performing the print job is shorter than a predetermined time period, the control section controls the motor so as to arrange the binding mechanism at the first position.

8. A sheet material binding apparatus according to claim 7, wherein, in a case where the image forming apparatus is in the state of being incapable of performing the print job and the estimated time period required until the image forming apparatus is brought into a state of being capable of performing the print job is longer than the predetermined time period, the control section controls the motor so as to arrange the binding mechanism at the second position.

9. A sheet material binding apparatus according to claim 7, wherein, in a case where the binding mechanism is located at the first position, the image forming apparatus is in the state of being incapable of performing the print job, and the estimated time period required until the image forming apparatus is brought into the state of being capable of performing the print job is shorter than the predetermined time period, the control section prohibits the binding mechanism from moving to the second position.

10. An image forming system, comprising:

an image forming section configured to form an image on a sheet material;

a binding mechanism configured to bind a sheet material bundle formed of a plurality of the sheet materials;

a motor configured to move a position of the binding mechanism between:

a first position, at which the binding mechanism stands by to bind a sheet bundle formed of a plurality of sheets fed from the image forming section in a print job, and a second position, at which the binding mechanism stands by to bind the sheet material bundle manually supplied; and a control section for controlling the motor so as to, in a case where the image forming section is in a state of being incapable of performing the print job, shift the binding mechanism to the second position.

11. An image forming system according to claim 10, wherein, in a case where the image forming section is in the state of being incapable of performing the print job and an estimated time period required until the image forming section is brought into a state of being capable of performing the print job is shorter than a predetermined time period, the control section controls the motor so as to shift the binding mechanism to the first position.

12. An image forming system according to claim 11, wherein, in a case where the image forming section is in the state of being incapable of performing the print job and an estimated time period required until the image forming section is brought into a state of being capable of performing the print job is longer than a predetermined time period, the control section controls the motor so as to shift the binding mechanism to the second position.

* * * * *